US010431160B2

(12) United States Patent
Zhang et al.

(10) Patent No.: US 10,431,160 B2
(45) Date of Patent: Oct. 1, 2019

(54) ORGANIC LIGHT EMITTING DIODE PANEL, GATE DRIVER CIRCUIT AND UNIT THEREOF

(71) Applicant: Peking University Shenzhen Graduate School, Guangdong (CN)

(72) Inventors: Shengdong Zhang, Guangdong (CN); Zhijin Hu, Guangdong (CN); Congwei Liao, Guangdong (CN); Wenjie Li, Guangdong (CN); Junmei Li, Guangdong (CN); Shijie Cao, Guangdong (CN)

(73) Assignee: Peking University Shenzhen Graduate School, Guangdong (CN)

( * ) Notice: Subject to any disclaimer, the term of this patent is extended or adjusted under 35 U.S.C. 154(b) by 59 days.

(21) Appl. No.: 15/555,456

(22) PCT Filed: Mar. 24, 2016

(86) PCT No.: PCT/CN2016/077260
§ 371 (c)(1),
(2) Date: Sep. 1, 2017

(87) PCT Pub. No.: WO2016/184254
PCT Pub. Date: Nov. 24, 2016

(65) Prior Publication Data

US 2018/0350306 A1 Dec. 6, 2018

(30) Foreign Application Priority Data

May 21, 2015 (CN) ..... 2015 1 02630965

(51) Int. Cl.
*G09G 5/10* (2006.01)
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0819* (2013.01);
(Continued)

(58) Field of Classification Search
CPC ..... G09G 3/3266; G09G 3/3233; G09G 2310/0251; G09G 2310/0286;
(Continued)

(56) References Cited

U.S. PATENT DOCUMENTS 9,336,716 B2 * 5/2016 Shin ..... G09G 3/3233
9,412,306 B2 * 8/2016 Kim ..... G09G 3/3208
(Continued)

FOREIGN PATENT DOCUMENTS

CN 102708795 A 10/2012
CN 104157236 A 11/2014
(Continued)

OTHER PUBLICATIONS

PCT Search Report and Written Opinion dated Jun. 29, 2016, International Application No. PCT/CN2016/077260, filed Mar. 24, 2016, 6 pages.

*Primary Examiner* — Vijay Shankar
(74) *Attorney, Agent, or Firm* — Lee & Hayes, P.C.

(57) ABSTRACT

An organic light emitting diode panel, a gate driver circuit and a gate driver circuit unit are disclosed, where the gate driver circuit includes a scanning signal generating unit for generating a scanning signal, transmitting a first clock signal to a scanning signal output terminal under the control of a pulse signal, and pulling down and maintaining the voltage of the scanning signal output terminal at a low voltage level under the control of a second clock signal. The gate driver circuit unit also includes a light emitting signal generating unit for generating a light emitting signal, pulling down the voltage of the light emitting signal output terminal under the
(Continued)

control of the pulse signal, and charging the light emitting signal output terminal under the control of the second clock signal.

13 Claims, 13 Drawing Sheets

(52) U.S. Cl.
CPC ..... *G09G 2300/0842* (2013.01); *G09G 2300/0861* (2013.01); *G09G 2310/0251* (2013.01); *G09G 2310/0286* (2013.01)

(58) Field of Classification Search
CPC ... G09G 2300/0842; G09G 2300/0861; G09G 2300/0819
See application file for complete search history.

(56) References Cited

U.S. PATENT DOCUMENTS

| | | | | |
|---|---|---|---|---|
| 9,524,675 | B2 * | 12/2016 | Wei ..... | G09G 3/3233 |
| 2014/0198091 | A1 | 7/2014 | Shin et al. | |
| 2015/0015554 | A1 | 1/2015 | Kim | |
| 2016/0019833 | A1 | 1/2016 | Wei et al. | |

FOREIGN PATENT DOCUMENTS

| | | | |
|---|---|---|---|
| CN | 104409038 | A | 3/2015 |
| KR | 20120028006 | A | 3/2012 |

* cited by examiner

ORGANIC LIGHT EMITTING DIODE PANEL, GATE DRIVER CIRCUIT AND UNIT THEREOF

CROSS REFERENCE TO RELATED APPLICATIONS

This application is a 35 USC § 371 filing of International Application No. PCT/CN2016/077260, filed Mar. 24, 2016, entitled ORGANIC LIGHT EMITTING DIODE PANEL, GATE DRIVER CIRCUIT AND UNIT THEREOF, which claims the benefit of China Patent Application No. CN201510263096.5, filed May 21, 2015, entitled ORGANIC LIGHT EMITTING DIODE PANEL, GATE DRIVER CIRCUIT AND UNIT THEREOF, which are incorporated herein by reference.

TECHNICAL FIELD

Aspects of the present disclosure relate to the flat panel display field, and more particularly, to a gate driver circuit and a gate driver circuit unit for organic light emitting diode panels.

BACKGROUND

In flat panel display field, organic light emitting display is regarded as the next generation panel that can replace liquid crystal display panel (TFT-LCD) due to the advantages of self-illumination high brightness, high contrast, high luminous efficiency, and fast response etc.

In an organic light emitting diode panel, since light emitting diodes are current type light emitting devices, each pixel in an organic light emitting diode panel has a pixel driver circuit for receiving a scanning signal and a data signal to control current in a light emitting pixel, so as to drive the lighting of the organic light emitting diode. However, after long time operating, threshold voltage of thin film transistors which constitute the pixel driver circuit may shift, which may shorten service life of the circuit and the panel. Therefore, in order to compensate the threshold voltage shift of thin film transistors in the pixel driver circuit, multiple control signal lines providing complex control signals are needed in the pixel driver circuit.

Traditional integrated gate driver circuits output only a scanning signal, and do not output a related control signal used for threshold voltage compensation, such as a light emitting signal. The light emitting signal is provided by external integrated circuit (IC), which not only brings high cost, but also is not good for the lightening and thinning of an organic light emitting diode panel.

SUMMARY

According to a first aspect of the present application, the present application provides a gate driver circuit unit, comprising: a pulse signal input terminal for inputting a pulse signal (VIN); a scanning signal output terminal for outputting a scanning signal (Vscan); a light emitting signal output terminal for outputting a light emitting signal (VEM); a first clock signal input terminal for inputting a first clock signal (VA); a second clock signal input for inputting a second clock signal (VB); a scanning signal generating unit 31 for generating a scanning signal (Vscan), configured to transmit the first clock signal (VA) to the scanning signal output terminal under the control of the pulse signal (VIN), and to pull down and maintain the voltage of the scanning signal output terminal at low voltage level under the control of the second clock signal (VB); a light emitting signal generating unit 32 for generating a light emitting signal (VEM), configured to pull down the voltage of the light emitting signal output terminal under the control of the pulse signal (VIN) and to charge the light emitting signal output terminal under the control of the second clock signal (VB); the configurations of signals are as follows: the first clock signal (VA) and the second clock signal (VB) are clock signals with the same period and duty cycle but different phases; a rising edge of high voltage level of the first clock signal (VA) precedes that of the second clock signal (VB); a rising edge of high voltage level of the pulse signal (VIN) precedes that of the first clock signal (VA), and a falling edge of high voltage level of the pulse signal (VIN) precedes the second clock signal (VB).

According to a second aspect of the present application, the present application provides a gate driver circuit, comprising N-stage cascaded gate driver circuit units according to claim 10, a first clock line (CK1), a second clock line (CK2), a third clock line (CK3), a fourth clock line (CK4), and a start signal line (ST); wherein N is an integer greater than 1; the first clock line (CK1), the second clock line (CK2), the third clock line (CK3), and the fourth clock line (CK4) are configured to provide four-phase clock signals; the start signal line (ST) is connected to the pulse signal input terminal of the first stage gate driver circuit unit and the initialization signal input terminals of the second to the Nth gate driver circuit units; the scanning signal output terminal of each stage gate driver circuit unit is connected to the pulse signal input terminal of a following stage gate driver circuit unit; the connections of the clock signals are as follows: the first clock signal input terminal of the (4K+1)th stage gate driver circuit unit is connected to the first clock line (CK1), and the second clock signal input terminal is connected to the second clock line (CK2); the first clock signal input terminal of the (4K+2)th stage gate driver circuit unit is connected to the second clock line (CK2), and the second clock signal input terminal is connected to the third clock line (CK3); the first clock signal input terminal of the (4K+3)th stage gate driver circuit unit is connected to the third clock line (CK3), and the second clock signal input terminal is connected to the fourth clock line (CK4); the first clock signal input terminal of the (4K+4)th stage gate driver circuit unit is connected to the fourth clock line (CK4), and the second clock signal input terminal is connected to the first clock line (CK1); wherein K is an integer greater than or equal to 0.

According to a third aspect of the present application, the present application provides an organic light emitting panel, comprising a two-dimensional pixel array including a plurality of pixels, a plurality of data lines in a first direction, a plurality of gate scanning lines and light emitting control lines in a second direction, which are connected to each pixel of the array; a data driver circuit for providing a data signal comprising a video image signal to the data line; further comprising: the above gate driver circuit for providing a scanning signal (Vscan) to the gate scanning line and providing a light emitting signal (VEM) to the light emitting control line.

According to the aforementioned organic light emitting panel, the gate driver circuit and the gate driver circuit unit, because the light emitting signal generating unit is introduced in herein, the gate driver circuit and the gate driver circuit unit can not only generate a scanning signal, but also generate a light emitting signal. Furthermore, the light emitting signal generating unit and the scanning signal generating unit share the pulse signal, the first clock signal and the second clock signal, so it is easy to integrate the light emitting signal generating unit into the gate driver circuit.

DETAILED DESCRIPTION

The present application is explained in detail below according to the embodiments in connection with the appended drawings.

The terminologies used herein are explained.

The transistor in this application is a three-terminal transistor, wherein the three terminals are a control electrode, a first electrode, and a second electrode. When the transistor is a bipolar transistor, the control electrode is the base of the bipolar transistor, the first electrode is the collector or the emitter of the bipolar transistor, and correspondingly, the second electrode is the emitter or the collector of the bipolar transistor. When the transistor is a field effect transistor, the control electrode is the gate of the field effect transistor, the first electrode is the drain or the source of the field effect transistor, and correspondingly, the second is the source or the drain of the field effect transistor.

In one of the embodiments, the transistors in this application are field effect transistors: thin film transistors (TFTs). The circuit is explained by taking the transistors as N-channel thin film transistors in the following. Correspondingly, in this situation, the control electrode of a transistor is the gate, the first electrode is the drain, and the second electrode is the source. Of course, in other embodiments, the transistors can be other types of field effect transistors or bipolar transistors.

The present application discloses a gate driver circuit and a unit thereof for providing a scanning signal and a light emitting signal to a pixel driver circuit of a panel, while traditional gate driver circuit can only provide a scanning signal to a pixel driver circuit, but cannot provide a light emitting signal.

Figure 1:
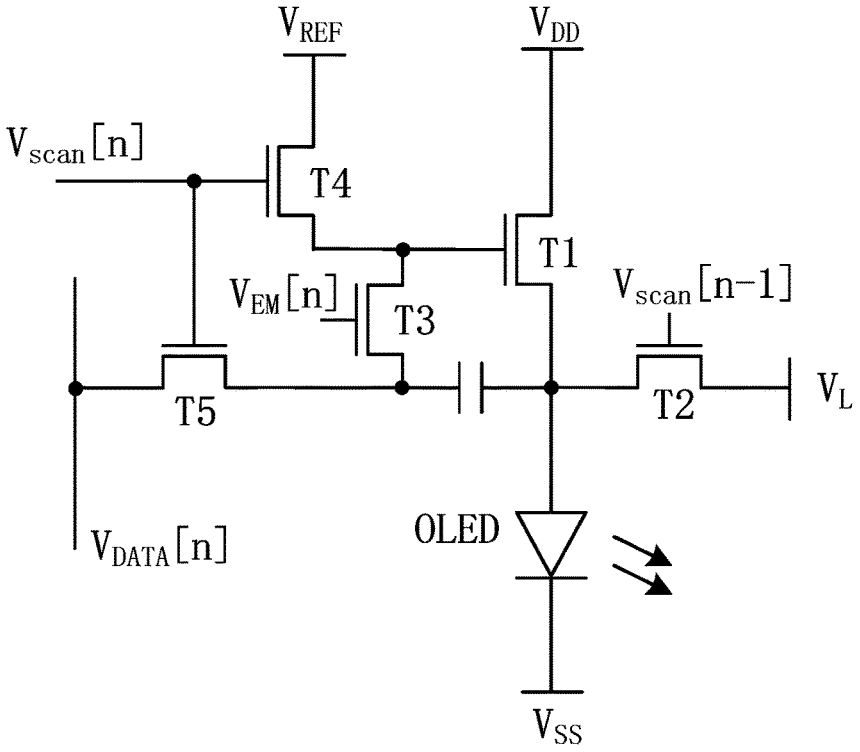
FIG. 1 illustrates a structure diagram of a pixel driver circuit of an organic light emitting diode panel.

FIG. 1 illustrates a structure diagram of a pixel driver circuit of an organic light emitting diode panel. In FIG. 1, the control electrode of a transistor T4 receives a scanning signal Vscan[n] of the nth row, the control electrode of a transistor T3 receives a light emitting signal VEM[n] of the nth row, the first electrode of a transistor T5 receives a data signal VDATA[n] of the nth row, and the control electrode of a transistor T2 receives a scanning signal Vscan[n−1] of the (n−1)th row. As can be seen in FIG. 1, both the gate scanning lines which provide scanning signals and the light emitting control lines which provide light emitting signals to the pixel driver circuit, are connected to gate terminals of the transistors. Therefore, in the whole panel, large load is connected to the gate scanning line and the light emitting control line.

Figure 2:
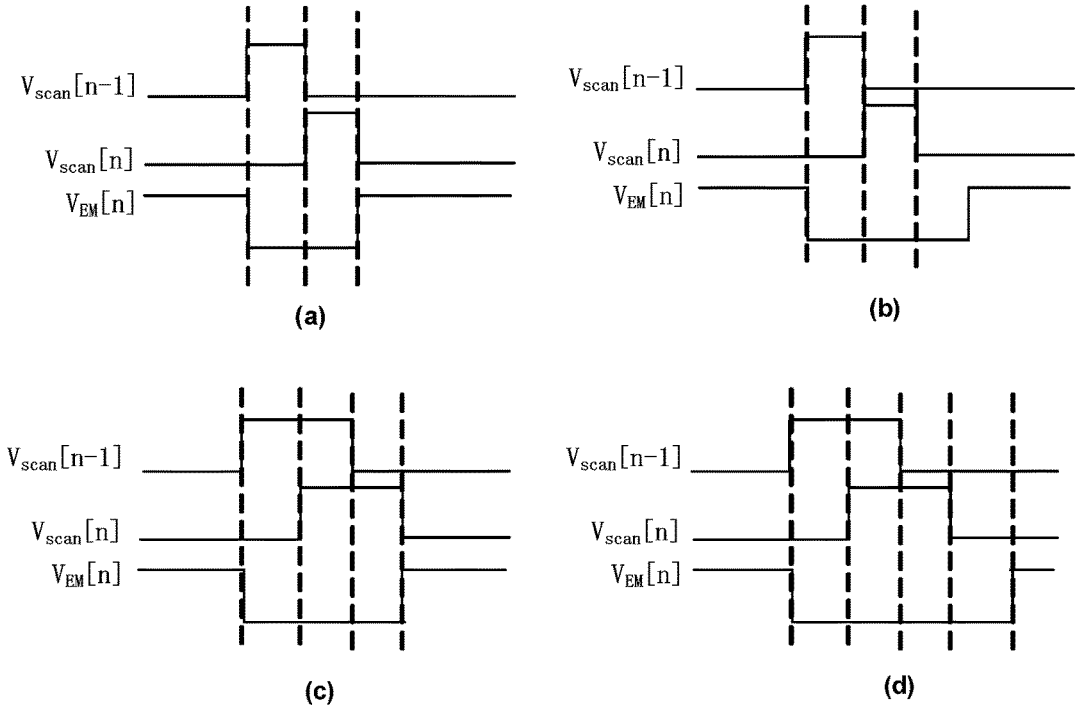
FIG. 2 illustrates four sequence diagrams of a pixel driver circuit of an organic light emitting diode panel.

FIG. 2 illustrates four sequence diagrams of the pixel driver circuit of FIG. 1. As can be seen in FIG. 2, the scanning signal Vscan[n] of the nth row and the scanning signal Vscan[n−1] of the (n−1)th row can be non-overlapping pulse signals or pulse signals with 50% pulse width overlapped. The light emitting signal VEM[n] of the nth row is a pulse signal with phases reversed to those of the scanning signals Vscan[n−1] and Vscan[n], and the pulse width of VEM[n] is greater than that of the scanning signals Vscan[n−1] and Vscan[n].

The gate driver circuit and the unit thereof according to the present application can provide the scanning signals and the light emitting signals conforming to the sequence of FIG. 2 to the pixel driver circuit of FIG. 1.

In embodiments of the present application, a light emitting signal generating unit is included in the gate driver circuit unit. The light emitting signal VEM can be outputted with full swing and have certain driving capability due to the bootstrap effect of the light emitting signal generating unit. The application is explained in detail below by referring to the embodiments.

Embodiment I

Figure 3:
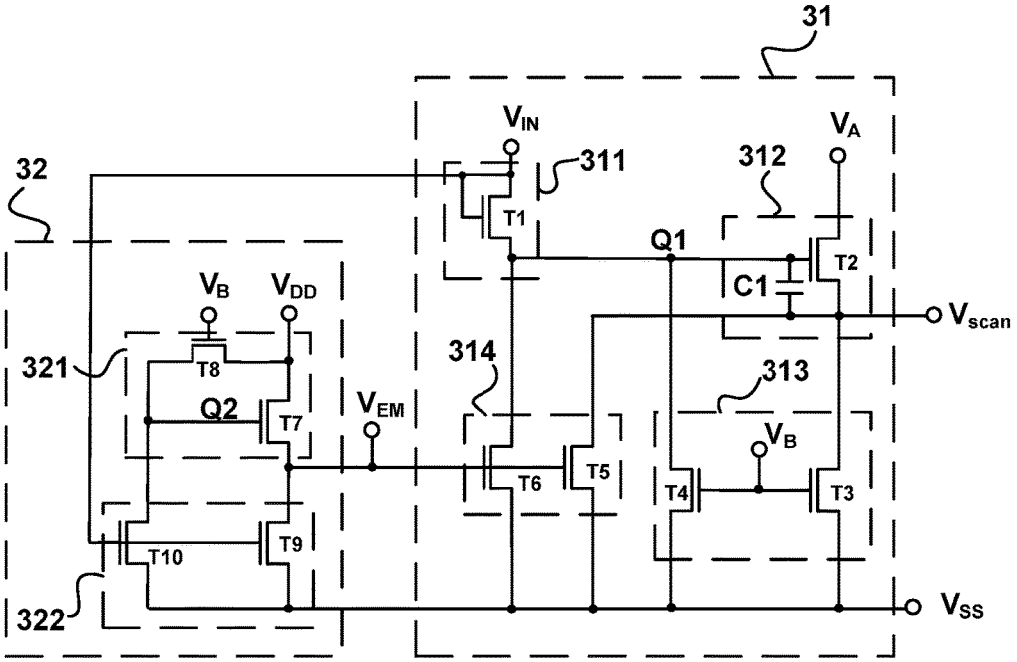
FIG. 3 illustrates a structure diagram of the gate driver circuit unit according to Embodiment I of the present application.

FIG. 3 illustrates a structure diagram of the gate driver circuit unit according to this embodiment of the present application. As illustrated in FIG. 3, the gate driver circuit unit comprises:

a pulse signal input terminal for inputting a pulse signal (VIN), a scanning signal output terminal for outputting a scanning signal (Vscan), a light emitting signal output terminal for outputting a light emitting signal (VEM), a first clock signal input terminal for inputting a first clock signal (VA), a second clock signal input terminal for inputting a second clock signal (VB), a scanning signal generating unit 31 for generating a scanning signal (Vscan), and a light emitting signal generating unit 32 for generating a light emitting signal (VEM). The embodiment is further described as follow.

In this embodiment, the scanning signal generating unit 31 is configured to transmit the first clock signal (VA) to the scanning signal output terminal under the control of the pulse signal (VIN), and is configured to pull down the voltage of the scanning signal output terminal to maintain at low voltage level under the control of the second clock signal (VB). In a preferred embodiment, the scanning signal generating unit 31 comprises an input module 311, a first pull-up module 312, and a first pull-down module 313. The first pull-up module 312 comprises a first control terminal Q1. After obtaining the driving voltage, the first control terminal Q1 of the first pull-up module 312 is configured to transmit the first clock signal VA to the scanning signal output terminal. Specifically, the first pull-up module 312 may include a transistor T2 and a capacitor C1. The capacitor C1 may be connected between the control electrode and the second electrode of the transistor T2. The control electrode of the transistor T2 may be the first control terminal (Q1). The first electrode of the transistor T2 may be used to input the first clock signal (VA). The second electrode of the transistor T2 may be connected to the scanning signal output terminal, so that after the transistor T2 is turned on by the driving voltage, the scanning signal output terminal may be charged when the first clock signal (VA) is at high voltage level and the scanning signal output terminal may be discharged when the first clock signal (VA) is at low voltage level. The input module 311 is configured to receive the input pulse signal (VIN) from the pulse signal input terminal, and is configured to provide the driving voltage to the first control terminal (Q1) of the first pull-up module 312. Specifically, the input module 311 may include a transistor T1. Both the first electrode and the control electrode of the transistor T1 may be connected to the pulse signal input terminal to input the pulse signal (VIN). The second electrode of the transistor T1 may be connected to the first control terminal (Q1) of the first pull-up module 312, so that the first control terminal (Q1) of the first pull-up module 312 may be charged and may be provided with the driving voltage when the input pulse signal (VIN) is at high voltage level. The first pull-down module 313 is configured to pull down the voltage of the scanning signal output terminal and to maintain it at the low voltage level under the control of the second clock signal (VB). Specifically, the first pull-down module 313 may include a transistor T3 and a transistor T4. The control electrode of the transistor T3 may be used to input the second clock signal (VB). The second electrode of T3 may be connected to the low voltage supply (VSS), wherein the voltage level of the low voltage supply (VSS) may be VL. The first electrode of the transistor T3 may be connected to the scanning signal output terminal, so that the scanning signal output terminal may be discharged through the low voltage supply (VSS) when the second clock signal (VB) is at high voltage level. The control electrode of the transistor T4 may be used to input the second clock signal (VB). The second electrode may be connected to the low voltage supply (VSS). The first electrode of the transistor T4 may be connected to the first control terminal (Q1), so that the first control terminal (Q1) may be discharged through the low voltage supply (VSS) when the second clock signal (VB) is at high voltage level. In other preferred embodiments, the scanning signal generating unit 31 may also comprise a low voltage level maintenance unit (314), which is configured to pull down the voltages of the first control terminal (Q1) and the scanning signal output terminal and to maintain such voltages at the low voltage level under the control of the light emitting signal (VEM). Specifically, the scanning signal generating unit 31 may include a transistor T5 and a transistor T6. The control electrode of the transistor T5 may be connected to the light emitting signal output terminal for inputting the light emitting signal (VEM). The second electrode of the transistor T5 may be connected to the low voltage supply (VSS), and the first electrode of the transistor T5 may be connected to the scanning signal output terminal, so that the voltage of the scanning signal output terminal may be maintained at the low voltage level, by discharging the scanning signal output terminal through the low voltage supply (VSS) when the light emitting signal (VEM) is at high voltage level. The control electrode of the transistor T6 may be connected to the light emitting signal output terminal for inputting the light emitting signal (VEM); the second electrode of the transistor T6 may be connected to the low voltage supply (VSS), and the first electrode of the transistor T6 may be connected to the first control terminal (Q1), so that the voltage of the first control terminal (Q1) may be maintained at the low voltage level by discharging the first control terminal (Q1) through the low voltage supply (VSS) when the light emitting signal (VEM) is at the high voltage level.

The light emitting signal generating unit 32 is configured to pull down the voltage of the light emitting signal output terminal under the control of the pulse signal (VIN), and is also configured to charge the light emitting signal output terminal under the control of the second clock signal (VB). In a preferred embodiment, the light emitting signal generating unit 32 may comprise a second control terminal (Q2), a second pull-up module 321, and a second pull-down module 322. The second control terminal (Q2) may be configured to, after obtaining a driving voltage, drive the second pull-up module 321 to pull up the voltage of the light emitting signal output terminal and maintain such voltage. The second pull-up module 321 is configured to charge the second control terminal (Q2) and to provide the driving voltage when the second clock signal (VB) is at high voltage level. Specifically, the second pull-up module (321) may include a transistor T7 and a transistor T8. The control electrode of the transistor T8 may be used to input the second clock signal (VB). The first electrode of the transistor T8 may be connected to a high voltage supply (VDD), wherein the voltage of the high voltage supply (VDD) may be VH. The second electrode of the transistor T8 may be connected to the second control terminal (Q2), the second control terminal (Q2) may be charged when the second clock signal (VB) is at the high voltage level, so as to provide the driving voltage. The control electrode of the transistor T7 may be connected to the second control terminal (Q2). The first electrode of the transistor T7 may be connected to a high voltage supply (VDD). The second electrode of the transistor T7 may be connected to the light emitting signal output terminal, so that the light emitting signal output terminal may be charged by the high voltage supply (VDD) after the transistor T7 is turned on by the driving voltage. The second pull-down module 322 may be configured to pull down the voltages of the light emitting signal output terminal and the second control terminal Q2 when the pulse signal (VIN) is at the high voltage level. Specifically, the second pull-down module 322 may include a transistor T9 and a transistor T10. The control electrode of the transistor T9 may be connected to the pulse signal input terminal to input a pulse signal (VIN). The second electrode of the transistor T9 may be connected to the low voltage supply (VSS). The first electrode of the transistor T9 may be connected to the light emitting signal output terminal, so that the voltage of the light emitting signal output terminal may be pulled down through the low voltage supply (VSS) when the input pulse signal (VIN) is at the high voltage level. The control electrode of the transistor T10 may be connected to the pulse signal input terminal to input a pulse signal (VIN). The second electrode of the transistor T10 may be connected to a low voltage supply (VSS). The first electrode of the transistor T10 may be connected to the second control terminal (Q2), so that the voltage of the second control terminal (Q2) may be pulled down through the low voltage supply (VSS) when the input pulse signal (VIN) at high voltage level.

Figure 4:
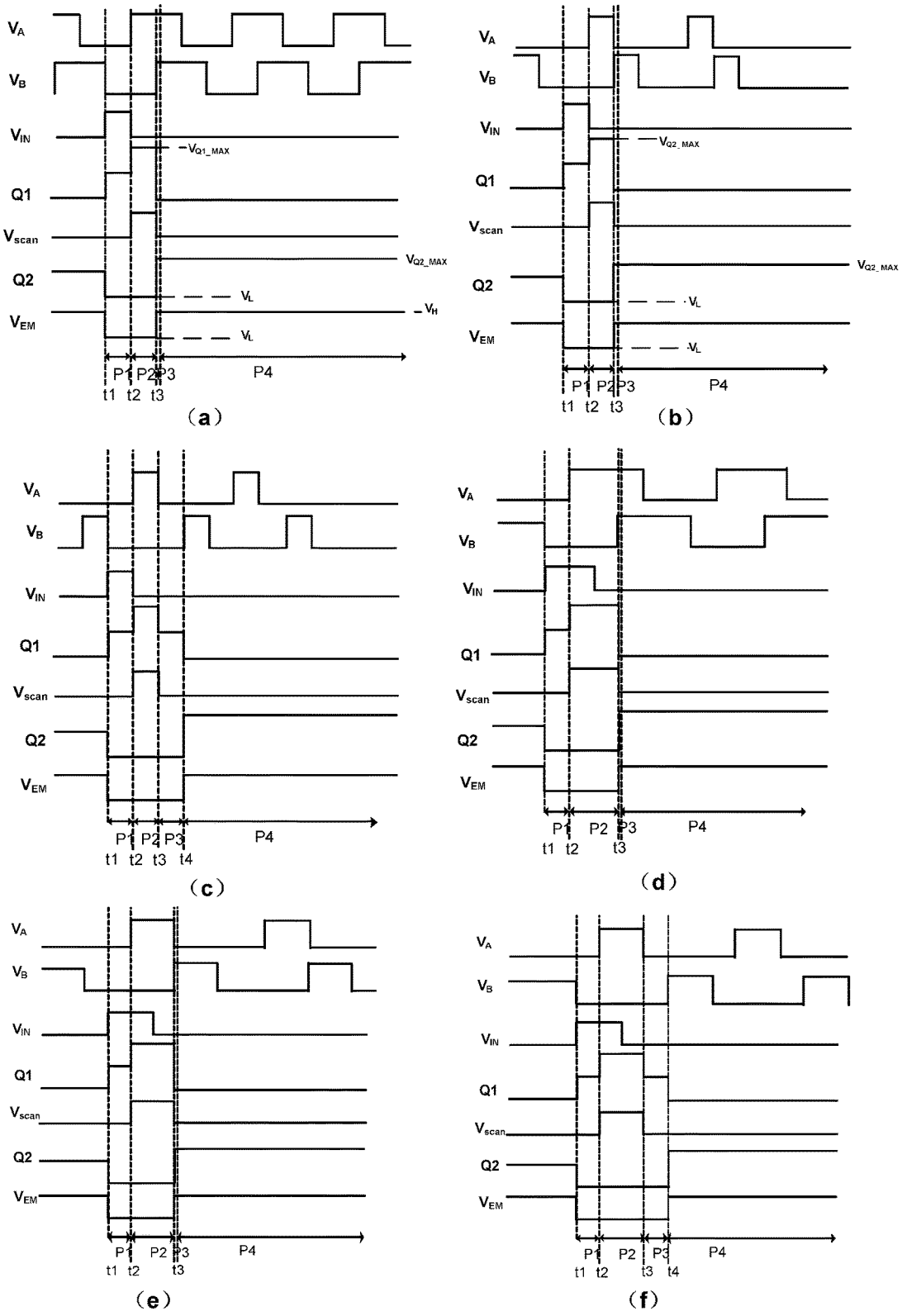
FIG. 4 illustrates six sequence diagrams of the gate driver circuit unit according to Embodiment I of the present application.

FIG. 4 illustrates several sequence diagrams of the gate driver circuit unit according to this embodiment of the present application, to provide the several sequence diagrams illustrated in FIG. 2. In this embodiment, signals of the gate driver circuit unit may be configured as follow: the first clock signal (VA) and the second clock signal (VB) may be clock signals with the same period and duty cycle but different phases; the rising edge of the high voltage level of the first clock signal (VA) may precede that of the second clock signal (VB); the rising edge of the high voltage level of the pulse signal (VIN) may precede that of the first clock signal (VA), and the falling edge of the high voltage level of the pulse signal (VIN) may precede the rising edge of the high voltage level of the second clock signal (VB).

In this embodiment, the work process of the gate driver circuit unit may include four phases: pre-charging phase P1, pulling-up phase P2, pulling-down phase P3, and voltage level maintenance phase P4.

Below, the sequence diagram of FIG. 4(*a*) may be used to explain the above four phases in detail. In this sequence diagram, the pulse width of each of the first clock signal (VA) and the second clock signal (VB) is 2T, and the overlapping width of high voltage level pulses is T. The pulse width of the pulse signal (VIN) is T. As can be seen in this figure, the pulse signal (VIN) and the scanning signal (Vscan) have the same pulse width T, and their pulses are not overlapping. Detailed descriptions are as follows.

1. Pre-Charging Phase P1

At time t1, the pulse signal (VIN) may rise to the high voltage level VH, and the second clock signal (VB) may fall to the low voltage level VL. Therefore, the transistor T3, the transistor T4, and the transistor T8, whose control electrodes are connected to the second clock signal input terminal, may be turned off. The transistor T1 may be turned on to charge the first control terminal (Q1), and the voltage of the first control terminal (Q1) may be charged to VH-VTH1, wherein VTH1 is the threshold voltage of the transistor T1. After being charged, the first control terminal (Q1) may obtain a driving voltage to turn on the transistor T2. At this time, the first clock signal (VA) is at low voltage level, so the transistor T2 may transfer the low voltage level of the first clock signal (VA) to the scanning signal output terminal, rendering the scanning signal (Vscan) to be at low voltage level VL.

As stated above, at t1, the pulse signal (VIN) may rise to the high voltage level VH, therefore the transistors T9 and T10 may be turned on, pulling down the voltages of the second control terminal (Q2) and the light emitting signal output terminal to the low voltage level VL.

2. Pulling Up Phase P2

At t2, the first clock signal (VA) may rise from the low voltage level to the voltage high level. The scanning signal output terminal may be charged by the turned-on transistor T2, and the voltage of the scanning signal (Vscan) may rise. With rising of the voltage of the scanning signal (Vscan), the voltage of the first control terminal (Q1) may be coupled to a higher voltage VQ1_MAX due to the bootstrap effect, which in turn may increase the driving capability of the transistor T2, causing the scanning signal (Vscan) rising to the high voltage level VH quickly.

3. Pulling Down Phase P3

At t3, the pulse signal (VIN) may fall from the high voltage level to the low voltage level, and the transistors T1, T9, and T10 may be turned off. At t3, the voltage of the second clock signal (VB) may rise from the low voltage level to the high voltage level, and the transistors T3 and T4 may be turned on, which may pull down the voltages of the first control terminal (Q1) and the scanning signal output terminal to the low voltage level VL. It should be noted that although the first clock signal (VA) is still at the high voltage level, the transistor T2 may be turned off quickly when charges of the first control terminal (Q1) are released quickly by the transistor T4. Thus, the voltage of the scanning signal output terminal can be pulled down quickly by the transistor T3.

As stated above, at t3, the voltage of the second clock signal (VB) may rise from the low voltage level to the high voltage level, so the transistor T8 may be turned on. The high voltage supply (VDD) may charge the second control terminal (Q2) though T8. When the voltage of the second control terminal (Q2) is greater than the threshold voltage VTH7 of the transistor T7, the transistor T7 may be turned on. The high voltage supply (VDD) may charge the light emitting signal output terminal through the transistor T7, so the voltage of the light emitting signal (VEM) may begin to rise. It should be noted that, as stated above, since the light emitting signal output terminal is usually connected to a large RC load, the light emitting signal (VEM) usually has a relative long rising time. However, in this embodiment, when the voltage of the second control terminal (Q2) is quickly charged to VH-VTH8, the voltage of the control electrode of the transistor T8 is VH, and the voltage of the second electrode is VH-VTH8, so the transistor T8 may be turned off and the second control (Q2) may be at the floating state. As the voltage of the light emitting signal (VEM) rises, the voltage of the second control terminal (Q2) may rise to the voltage VQ2_MAX which is higher than VH, due to the bootstrap effect, which in turn increases the driving capability of the transistor T7, so as to accelerate the charging speed of the light emitting signal output terminal, causing the voltage of the light emitting signal VEM to be charged quickly to the high voltage level VH.

4. Voltage Level Maintenance Phase P4

After t3 and a very short time after t3, the gate driver circuit may enter the voltage level maintenance phase P4. After the pulling down phase P3, the voltage of the scanning signal (Vscan) need to be maintained at the low voltage level VL for a long time to prevent the transistors in the pixel driver circuit connected to the scanning signal output terminal from being turned on by mistake which may cause write error of data signal. Due to the parasitic capacitance between the control electrode and the first electrode of the transistor T2, as the high voltage level pulse of the first clock signal (VA) appears periodically, a high noise voltage may be generated at the first control terminal (Q1) and the scanning signal output terminal. When the noise voltage at the first control terminal (Q1) is higher than the threshold voltage of the transistor T2, the transistor T2 may be turned on by mistake, which may cause the high voltage level pulse of first clock signal (VA) charging the scanning signal output terminal by mistake, and therefore may be difficult to maintain the scanning signal (Vscan) at the low voltage level.

Therefore, the low voltage level maintenance unit 314 is introduced in this embodiment to maintain the first control terminal (Q1) and the scanning signal output terminal at the low voltage level. Specifically, after the light emitting signal (VEM) rises to the high voltage level, the transistor T5 and the transistor T6 may be turned on, so that the voltages of the first control terminal (Q1) and the scanning signal output terminal may be maintained at the low voltage level through the low voltage supply (VSS). Before a next high voltage level of the pulse signal (VIN) arrives, the light emitting signal (VEM) may be maintained at the high voltage level, so that the transistor T5 and the transistor T6 may be at on-state and the voltages of the first control terminal (Q1) and the scanning signal output terminal may be maintained at the low voltage level.

It should be noted that, after the t3, the voltage of the light emitting signal (VEM) can be maintained at the high voltage level VH for a long time. This is because the transistor T8 is at off-state, and on the other hand, the control electrodes of the transistors T9 and T10 are connected to the pulse signal input terminal, and since the noise voltage of the pulse signal (VIN) is low, the transistors T9 and T10 may also be at off-state and have low leakage. Therefore, after t3, the second control terminal (Q2) may be at the floating state and the voltage of the second control terminal (Q2) can be maintained at VQ2_MAX for a long time. When VQ2_MAX−VH>VTH7, the transistor T7 may be turned on to maintain the high voltage level of the light emitting signal output terminal. At the same time, the transistor T9 may be turned off, and the high voltage level at the light emitting signal output terminal may not be pulled down by the low voltage supply (VSS).

The above is a sequence diagram of the gate driver circuit unit according to this embodiment, which outputs a scanning signal pulse and a light emitting signal pulse, and the sequences of the scanning signal (Vscan) and the light emitting signal (VEM) meet the time sequence requirement of the pixel driver circuit in FIG. 1, i.e., the time sequence requirement of FIG. 2(*a*). Besides, the gate driver circuit unit of this embodiment can meet more time sequence requirements of a pixel driver circuit by adjusting the sequences of the first clock signal (VA), the second clock signal (VB), and the pulse signal (VIN). Detailed descriptions are as follows.

FIG. 4(*b*) is a second sequence diagram of the gate driver circuit unit according to this embodiment. Compared with FIG. 4(*a*), in FIG. 4(*b*), the high voltage levels of the first clock signal (VA) and the high voltage levels of the second clock signal (VB) are not overlapping. At t3, the voltage of the first clock signal (VA) may fall from the high voltage level to the low voltage level, while the voltage of the second clock signal (VB) rises from the low voltage level to the high voltage level. The advantage of the sequence illustrated in FIG. 4(*b*) is that: at t3, the instantaneous direct current path caused by failing to turn off the transistor T2 timely can be well suppressed, so as power consumption of the circuit may be reduced. The sequence illustrated in FIG. 4(*b*) can meet the sequence requirement of a pixel driver circuit illustrated in FIG. 2(*a*).

FIG. 4(*c*) is a third sequence diagram of the gate driver circuit unit according to this embodiment. Compared with FIG. 4(*b*), in FIG. 4(*c*), the high voltage level of the second clock signal (VB) lags behind the high voltage level of the first clock signal (VA) by the pulse width of one high voltage level. The advantage of the sequence illustrated in FIG. 4(*c*) is that: at t3 to t4, the transistor T2 is at on-state, and the first clock signal (VA) is at the low voltage level, so the scanning signal output terminal can be discharged quickly by the on-state transistor T2. As such, the size of the transistor T3 in the circuit can be reduced, or the transistor T3 can be removed to simplify the circuit and reduce the area. The sequence illustrated in FIG. 4(*c*) can meet the sequence requirement of a pixel driver circuit illustrated in FIG. 2(*b*).

FIG. 4(*d*) is a fourth sequence diagram of the gate driver circuit unit according to this embodiment. Compared with FIG. 4(*c*), in FIG. 4(*d*), the first clock signal (VA) overlaps the second clock signal (VB) by a pulse width of ⅓ high voltage level, and the pulse signal (VIN) also overlaps the output the scanning signal (Vscan) by a pulse width of ⅓ high voltage level. In the sequence illustrated in FIG. 4(*d*), the work process of the gate driver circuit unit is similar to that illustrated in FIG. 4(*a*) and need not be repeated here. The sequence illustrated in FIG. 4(*d*) can meet the sequence requirement of a pixel driver circuit illustrated in FIG. 2(*c*).

FIG. 4(*e*) is a fifth sequence diagram of the gate driver circuit unit according to this embodiment. Compared with FIG. 4(*d*), in FIG. 4(*e*), the high voltage levels of the first clock signal (VA) and the high voltage levels of the second clock signal (VB) are not overlapping, and the pulse signal (VIN) overlaps the output the scanning signal (Vscan) by a pulse width of ½ high voltage level. At t3, the second clock signal (VB) rises from the low voltage level to the high voltage level, the first clock signal (VA) falls from the high voltage level to the low voltage level. The advantage of the sequence illustrated in FIG. 4(*e*) is that: at t3, the instantaneous direct current path caused by failing to turn off the transistor T2 timely can be well suppressed, so as to reduce power consumption of the circuit. The sequence illustrated in FIG. 4(*e*) can meet the sequence requirement of a pixel driver circuit illustrated in FIG. 2(*c*).

FIG. 4(*f*) is a sixth sequence diagram of the gate driver circuit unit according to this embodiment. Compared with FIG. 4(*e*), in FIG. 4(*f*), the high voltage level of the second clock signal (VB) lags behind the high voltage level of the first clock signal (VA) by a pulse width of ½ high voltage level, and the pulse signal (VIN) overlaps the output the scanning signal (Vscan) by a pulse width of ½ high voltage level. The advantage of the sequence illustrated in FIG. 4(*f*) is that: at t3 to t4, the transistor T2 is at on-state, and the first clock signal (VA) is at the low voltage level, so the scanning signal output terminal can be discharged quickly by the on-state transistor T2. As such, the size of the transistor T3 in the circuit can be reduced, or the transistor T3 can be removed to simplify the circuit and reduce the area. The sequence illustrated in FIG. 4(*f*) can meet the sequence requirement of a pixel driver circuit illustrated in FIG. 2(*d*).

Embodiment II

Figure 5:
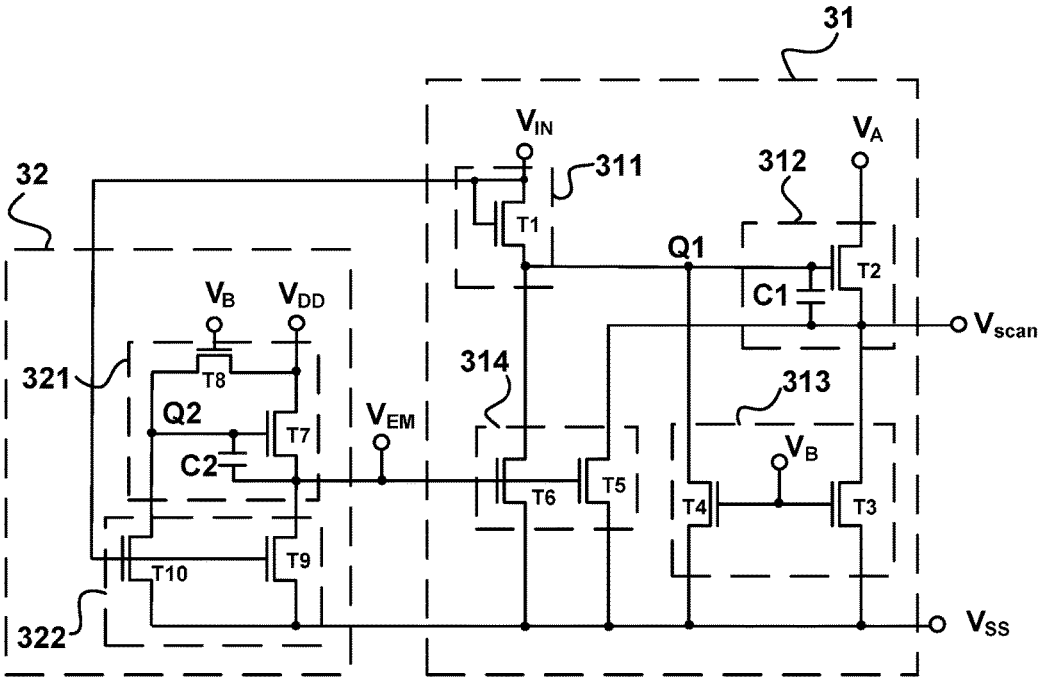
FIG. 5 illustrates a structure diagram of the gate driver circuit unit according to Embodiment II of the present application.

FIG. 5 illustrates a structural diagram of the gate driver circuit unit according to this embodiment of the present application. On basis of Embodiment I, the second pull-up module 321 of the gate driver circuit unit in this embodiment also comprises a capacitor C2, which is connected between the second control terminal (Q2) and the light emitting signal output terminal. The sequences of the gate driver circuit unit in this embodiment are the same as those in Embodiment I, comprising six kinds of sequences illustrated in FIG. 4(*a*) to FIG. 4(*f*).

It should be noted that, after adding the capacitor C2 to the gate driver circuit unit, during the rising phase of the voltage of the light emitting signal (VEM), the voltage bootstrap effect of the transistor T2 can be enhanced. Therefore, the voltage of the transistor T2 can be lifted to a voltage higher than VQ2_MAX in Embodiment I, so that the transistor T7 may have a stronger drive capability, and the time for the light emitting signal (VEM) rising to the high voltage level VH may be reduced.

Embodiment III

Figure 6:
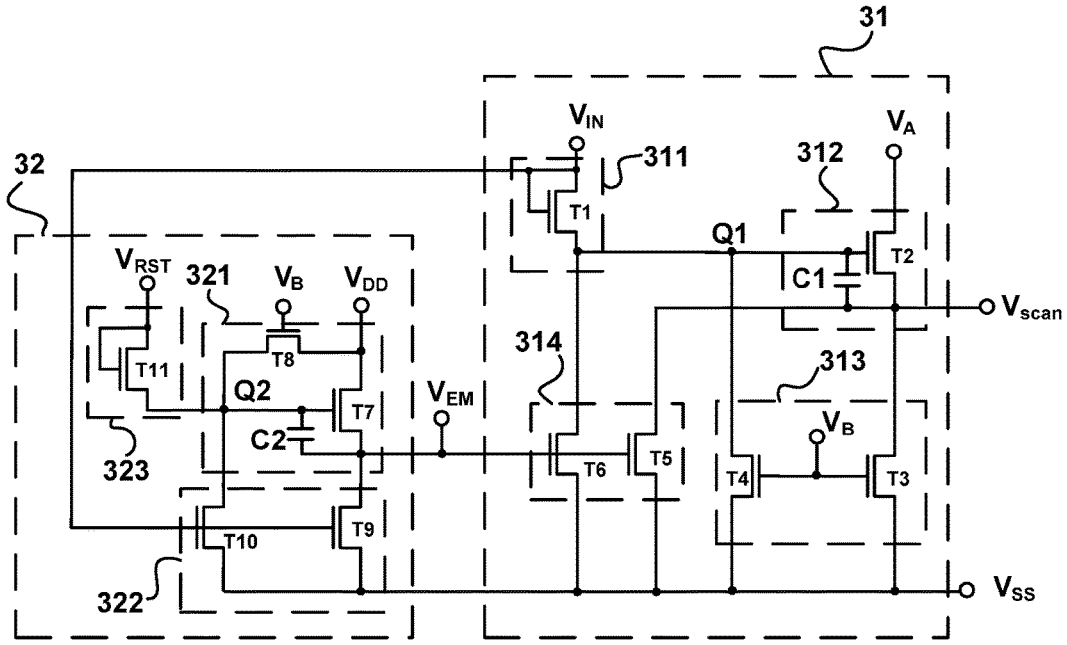
FIG. 6 illustrates a structure diagram of the gate driver circuit unit according to Embodiment III of the present application.

On basis of Embodiment I and Embodiment II, the gate driver circuit unit of the present application also comprises an initialization module. Taking Embodiment II as an example and referring to FIG. 6, the gate driver circuit unit of the present application may also comprise an initialization module 323 for pulling up the voltage of the light emitting output terminal to the high voltage level and pulling down the voltage of the scanning signal output terminal to the low voltage level when an initialization signal (VRST) is at high voltage level, wherein the initialization signal (VRST) is input via an initialization signal input terminal.

In a preferred embodiment, the initialization module 323 may comprise a transistor T11. Both the first electrode and the control electrode of the transistor T11 may be connected to the initialization signal input terminal, for inputting the initialization signal (VRST). The second electrode of the transistor T11 may be connected to the second control terminal (Q2), for pulling up the voltage of the second control terminal (Q2) to the high voltage level when the initialization signal (VRST) is at the high voltage level, so that the transistor T7 may be turned on and the high voltage supply (VDD) may charge the light emitting signal output terminal to increase the voltage of the light emitting signal (VEM). After the voltage of the light emitting signal (VEM) is increased, the transistor T5 and the transistor T6 are turned on, so that the voltage of the scanning signal output terminal may be pulled down to the low voltage level.

The sequences of the gate driver circuit unit illustrated in this embodiment are the same as those of Embodiment I. The initialization signal (VRST) may be a pulse signal whose phase is ahead of the phase of the pulse signal VIN. The function of the initialization signal (VRST) is to maintain the voltages of the second control terminal (Q2) and the light emitting signal output terminal are charged to the high voltage level before t1, so that the circuit can work more reliably.

Embodiment IV

This embodiment discloses a gate driver circuit. In a preferred embodiment, the gate driver circuit may comprise N-stage cascaded gate driver circuit units illustrated in Embodiment III, wherein N is an integer greater than 1. Detailed descriptions are as follows.

Figure 7:
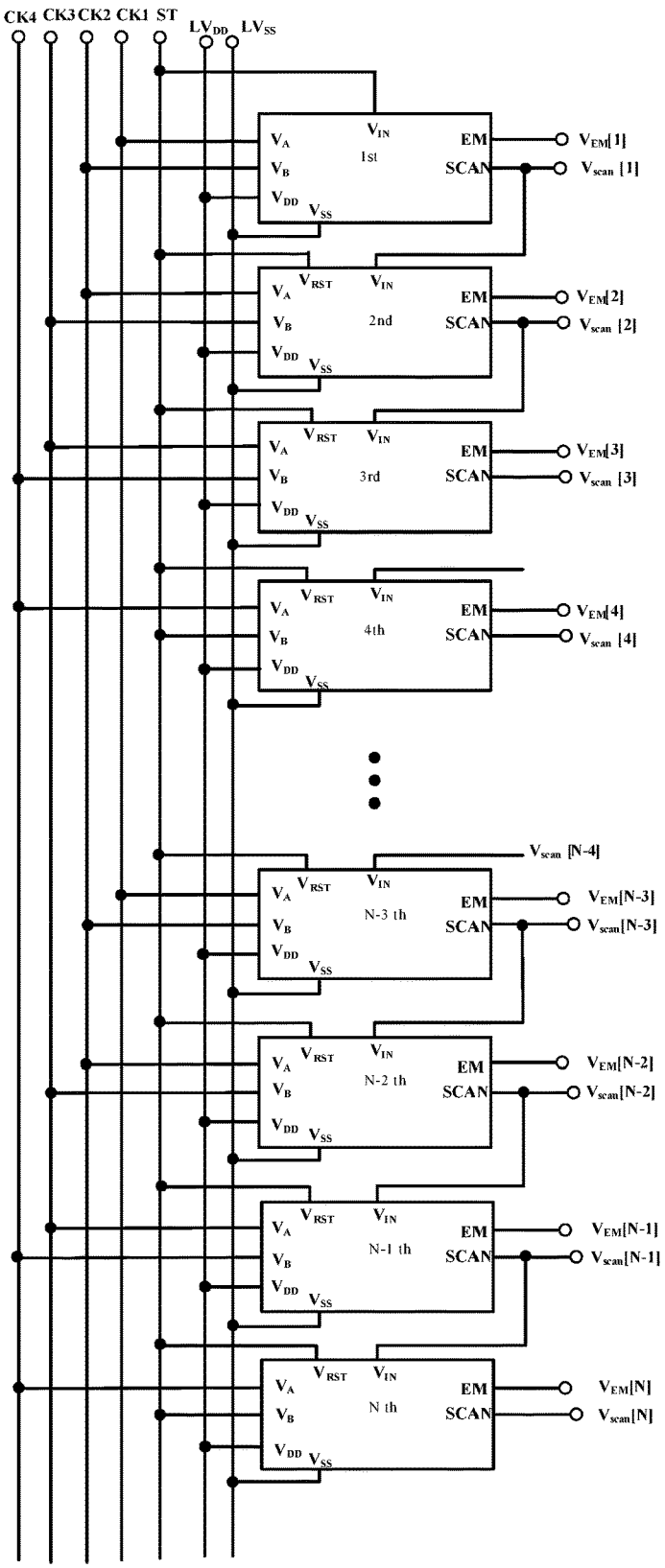
FIG. 7 illustrates a structure diagram of the gate driver circuit according to Embodiment IV of the present application.

Referring to FIG. 7, the gate driver circuit of this embodiment also comprises a first clock line (CK1), a second clock line (CK2), a third clock line (CK3), a fourth clock line (CK4), a start signal line (ST), a common high voltage level line (LVDD), and a common low voltage level line (LVSS).

The first clock line (CK1), the second clock line (CK2), the third clock line (CK3), and the fourth clock line (CK4) may be used to provide four-phase clock signals for the gate driver circuit. The start signal line (ST) may be connected to the pulse signal input terminal of the first stage gate driver circuit unit, and to the initialization signal input terminals of the second to the Nth stage gate driver circuit units. The scanning signal output terminal of each stage gate driver circuit unit may be connected to the pulse signal input terminal of a next stage gate driver circuit unit, that is, the scanning signal of one of the gate driver circuit units can be used as the pulse signal of its following stage gate driver circuit unit. The common high voltage level line (LVDD) may be connected to the high voltage supply (VDD) of the gate driver circuit unit at each stage. The common low voltage level line (LVSS) may be connected to the low voltage supply (VSS) of the gate drive circuit unit at each stage.

These clock signals may be connected in multiple ways, and one is explained as follows:

the first clock signal input terminal of the (4K+1)th stage gate driver circuit unit may be connected to the first clock line (CK1), and the second clock signal input terminal may be connected to the second clock line (CK2);

the first clock signal input terminal of the (4K+2)th stage gate driver circuit unit may be connected to the second clock line (CK2), and the second clock signal input terminal may be connected to the third clock line (CK3);

the first clock signal input terminal of the (4K+3)th stage gate driver circuit unit may be connected to the third clock line (CK3), and the second clock signal input terminal may be connected to the fourth clock line (CK4);

the first clock signal input terminal of the (4K+4)th stage gate driver circuit unit may be connected to the fourth clock line (CK4), and the second clock signal input terminal may be connected to the first clock line (CK1); wherein K is an integer greater than or equal to 0.

Figure 8:
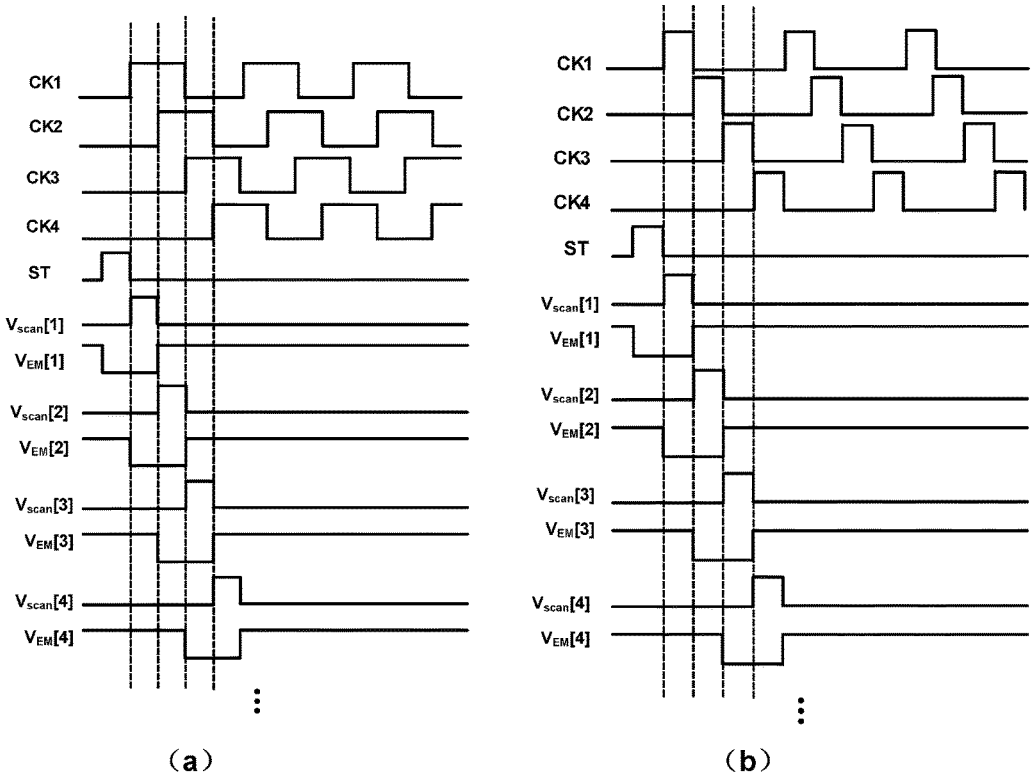
FIG. 8 illustrates two sequence diagrams of the gate driver circuit according to Embodiment IV of the present application.

FIG. 8(*a*) illustrates a first sequence diagram of the gate driver circuit according to this embodiment, wherein Vscan[1]~Vscan[N] are scanning signals output by the first to the Nth gate driver circuit units respectively, and VEM[1]~VEM[N] are light emitting signals output by the first to the Nth gate driver circuit units respectively. In this sequence, the first clock line (CK1), the second clock line (CK2), the third clock line (CK3), and the fourth clock line (CK4) provide four-phase clock signals, and clock signals provided by adjacent clock lines overlap by a pulse width of ½ high voltage level. The scanning signals and the light emitting signals output by the gate driver circuit of FIG. 8(*a*) can meet the sequence requirement of a pixel driver circuit illustrated in FIG. 2(*a*), wherein the sequence of the gate driver circuit unit of each stage in the gate driver circuit is shown in FIG. 4(*a*).

FIG. 8(*b*) illustrates a second sequence diagram of the gate driver circuit according to this embodiment. In this sequence, the first clock line (CK1), the second clock line (CK2), the third clock line (CK3), and the fourth clock line (CK4) provide four non-overlapping phase clock signals. The scanning signals and the light emitting signals output by the gate driver circuit of FIG. 8(*b*) can meet the sequence requirement of a pixel driver circuit illustrated in FIG. 2(*a*), wherein the sequence of the gate driver circuit unit of each stage in the gate driver circuit is shown in FIG. 4(*b*).

Figure 9:
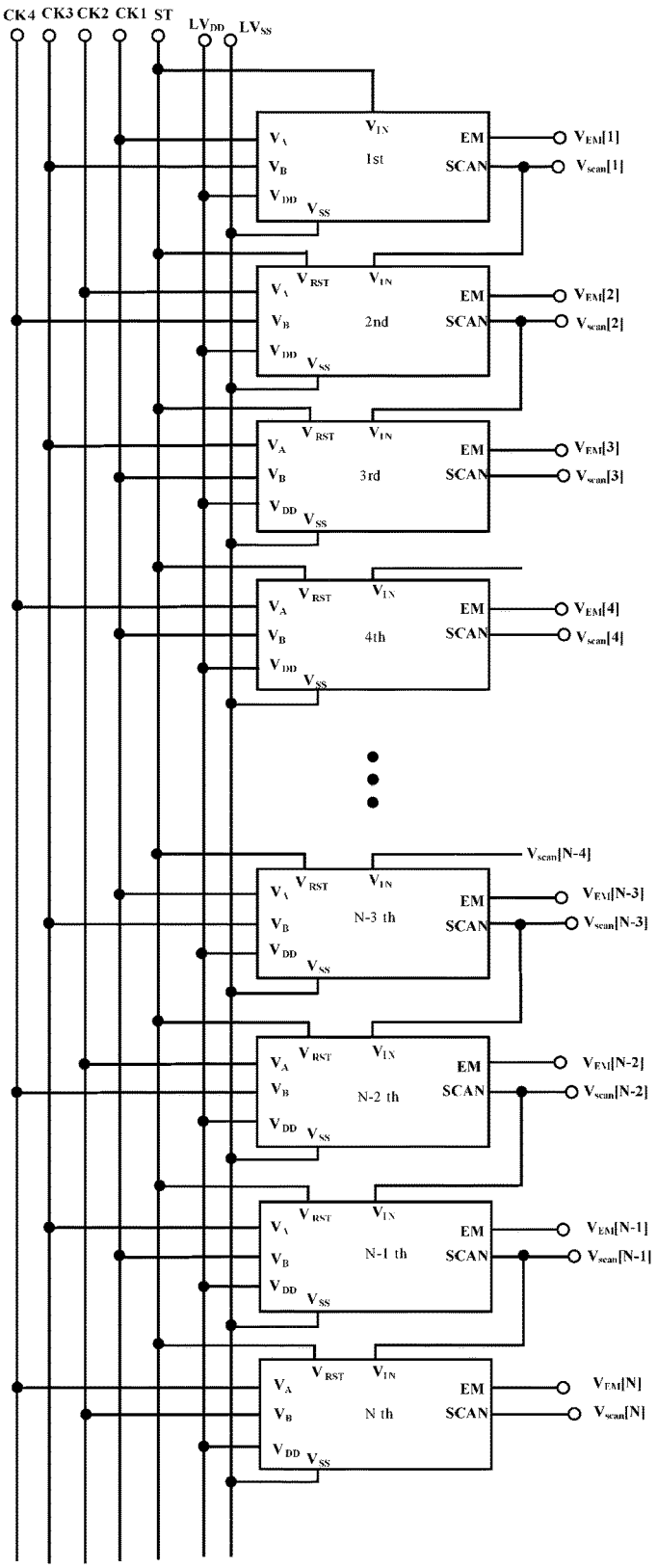
FIG. 9 illustrates another structure diagram of the gate driver circuit according to Embodiment IV of the present application.

As stated above, these clock signals may be connected in multiple ways, another connection way is as follow: referring to FIG. 9, in a preferred embodiment:

the first clock signal input terminal of the (4K+1)th stage gate driver circuit unit may be connected to the first clock line (CK1), and the second clock signal input terminal may be connected to the third clock line (CK3);

the first clock signal input terminal of the (4K+2)th stage gate driver circuit unit may be connected to the second clock line (CK2), and the second clock signal input terminal may be connected to the fourth clock line (CK4);

the first clock signal input terminal of the (4K+3)th stage gate driver circuit unit may be connected to the third clock line (CK3), and the second clock signal input terminal may be connected to the first clock line (CK1);

the first clock signal input terminal of the (4K+4)th stage gate driver circuit unit may be connected to the fourth clock line (CK4), and the second clock signal input terminal may be connected to the second clock line (CK2); wherein K is an integer greater than or equal to 0.

Figure 10:
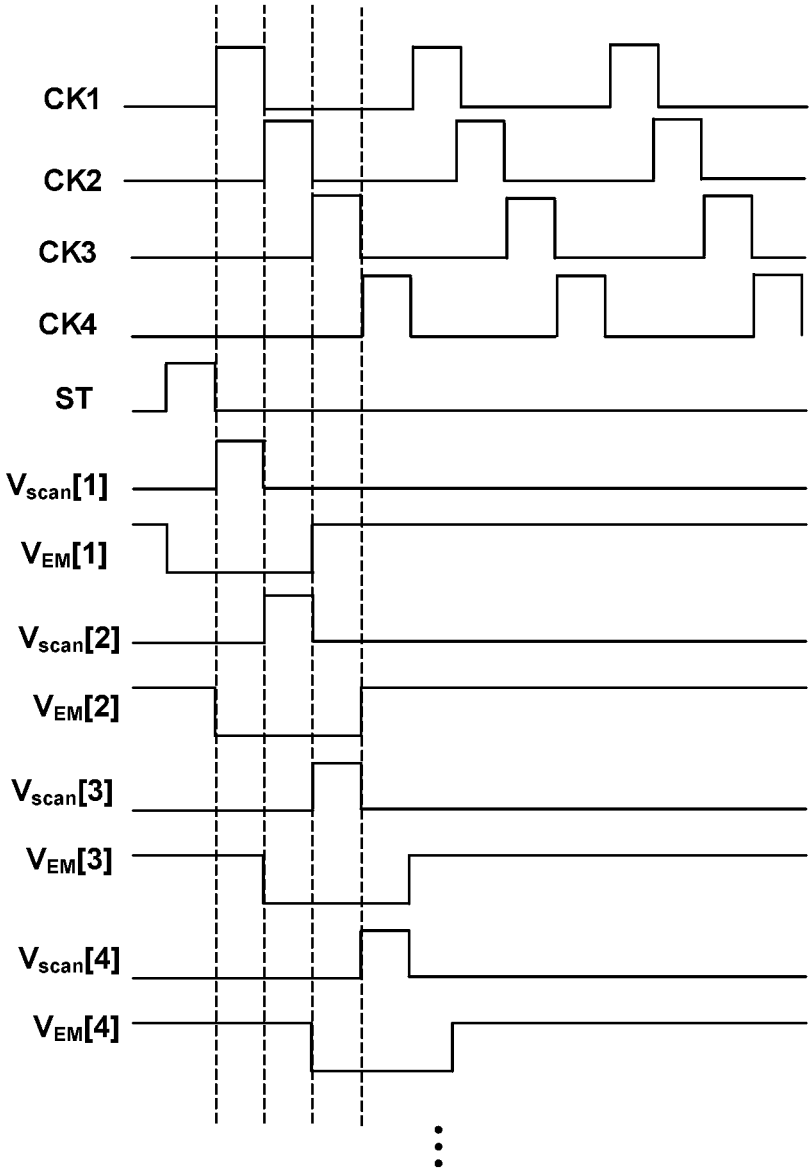
FIG. 10 illustrates another sequence diagram of the gate driver circuit according to Embodiment IV of the present application.

FIG. 10 illustrates a sequence diagram of the gate driver circuit according to this preferred embodiment, wherein the first clock line (CK1), the second clock line (CK2), the third clock line (CK3), and the fourth clock line (CK4) provide four non-overlapping phase clock signals. The scanning signals and the light emitting signals output by the gate driver circuit of FIG. 10 can meet the sequence requirement of a pixel driver circuit illustrated in FIG. 2(*b*), wherein the sequence of each gate driver circuit unit in the gate driver circuit is shown in FIG. 4(*c*).

Embodiment V

This embodiment discloses a gate driver circuit. In a preferred embodiment, the gate driver circuit may comprise N-stage cascaded gate driver circuit units illustrated in Embodiment III, wherein N is an integer greater than 1. Detailed descriptions are as follows.

Figure 11:
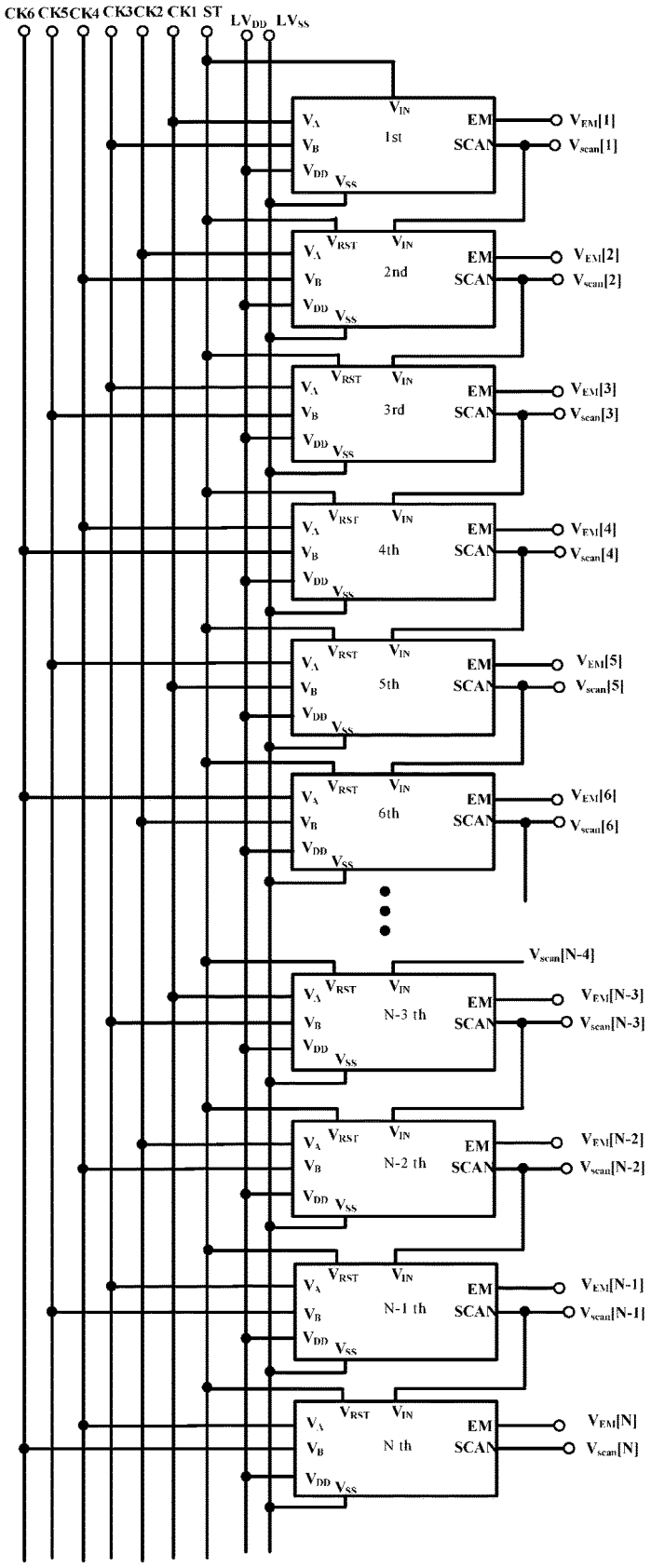
FIG. 11 illustrates a structure diagram of the gate driver circuit according to Embodiment V of the present application.

Referring to FIG. 11, the gate driver circuit of this embodiment also comprises a first clock line (CK1), a second clock line (CK2), a third clock line (CK3), a fourth clock line (CK4), a fifth clock line (CK5), a sixth clock line (CK6), a start signal line (ST), a common high voltage level line (LVDD), and a common low voltage level line (LVSS).

The first clock line (CK1), the second clock line (CK2), the third clock line (CK3), the fourth clock line (CK4), the fifth clock line (CK5), and the sixth clock line (CK6) may be used to provide six-phase clock signals. The start signal line (ST) may be connected to the pulse signal input terminal of the first stage gate driver circuit unit, and to the initialization signal input terminals of the second to the Nth stage gate driver circuit units. The scanning signal output terminal of each stage gate driver circuit unit may be connected to the pulse signal input terminal of the following stage gate driver circuit unit. The common high voltage level line (LVDD) may be connected to the high voltage supply (VDD) of each stage gate driver circuit unit. The common low voltage level line (LVSS) may be connected to the low voltage supply (VSS) of each stage gate driver circuit unit.

These clock signals may be connected in multiple ways, one is as follow: the first clock signal input terminal of the (6K+1)th stage gate driver circuit unit may be connected to the first clock line (CK1), and the second clock signal input terminal may be connected to the third clock line (CK3); the first clock signal input terminal of the (6K+2)th stage gate driver circuit unit may be connected to the second clock line (CK2), and the second clock signal input terminal may be connected to the fourth clock line (CK4); the first clock signal input terminal of the (6K+3)th stage gate driver circuit unit may be connected to the third clock line (CK3), and the second clock signal input terminal may be connected to the fifth clock line (CK5); the first clock signal input terminal of the (6K+4)th stage gate driver circuit unit may be connected to the fourth clock line (CK4), and the second clock signal input terminal may be connected to the sixth clock line (CK6); the first clock signal input terminal of the (6K+5)th stage gate driver circuit unit may be connected to the fifth clock line (CK5), and the second clock signal input terminal may be connected to the first clock line (CK1); the first clock signal input terminal of the (6K+6)th stage gate driver circuit unit may be connected to the sixth clock line (CK6), and the second clock signal input terminal may be connected to the second clock line (CK2); wherein K is an integer greater than or equal to 0.

Figure 12:
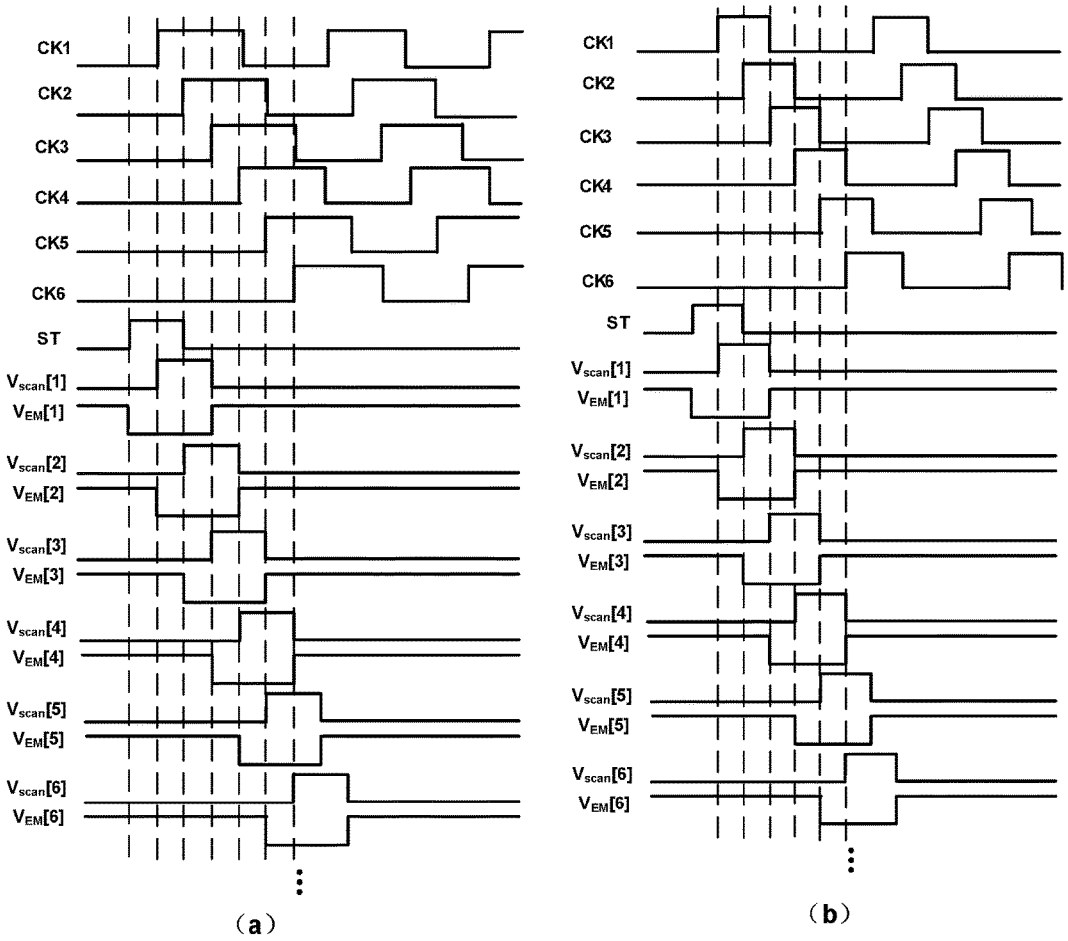
FIG. 12 illustrates two sequence diagrams of the gate driver circuit according to Embodiment V of the present application.

FIG. 12(*a*) illustrates a sequence diagram of the gate driver circuit according to this embodiment, wherein the first clock line (CK1), the second clock line (CK2), the third clock line (CK3), the fourth clock line (CK4) the fifth clock line (CK5), and the sixth clock line (CK6) provide six overlapping phase clock signals, and clock signals provided by adjacent clock lines overlap by a pulse width of ⅓ high voltage level. The scanning signals and the light emitting signals output by the gate driver circuit of FIG. 12(*a*) can meet the sequence requirement of a pixel driver circuit of FIG. 2(*c*), wherein the sequence of each gate driver circuit unit in the gate driver circuit is shown in FIG. 4(*d*).

FIG. 12(*b*) illustrates another sequence diagram of the gate driver circuit according to this embodiment, wherein the first clock line (CK1), the second clock line (CK2), the third clock line (CK3), the fourth clock line (CK4) the fifth clock line (CK5), and the sixth clock line (CK6) provide six overlapping phase clock signals, and clock signals provided by adjacent clock lines overlap by a pulse width of ½ high voltage level. The scanning signals and the light emitting signals output by the gate driver circuit of FIG. 12(*b*) can meet the sequence requirement of a pixel driver circuit of FIG. 2(*c*), wherein the sequence of each gate driver circuit unit in the gate driver circuit is shown in FIG. 4(*e*).

Figure 13:
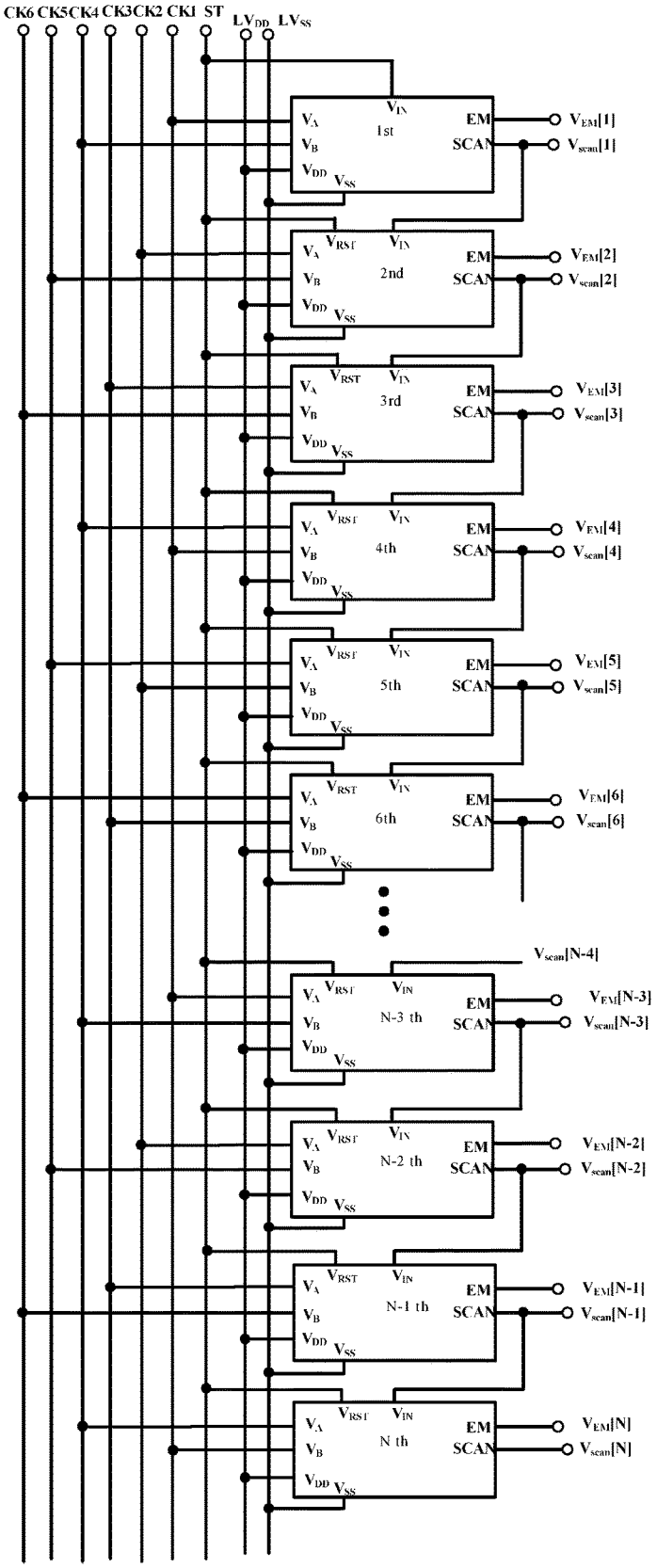
FIG. 13 illustrates another structure diagram of the gate driver circuit according to Embodiment V of the present application.

As stated above, these clock signals may be connected in multiple ways, another way is as follow: referring to FIG. 13, in a preferred embodiment: the first clock signal input terminal of the (6K+1)th stage gate driver circuit unit may be connected to the first clock line (CK1), and the second clock signal input terminal may be connected to the fourth clock line (CK4); the first clock signal input terminal of the (6K+2)th stage gate driver circuit unit may be connected to the second clock line (CK2), and the second clock signal input terminal may be connected to the fifth clock line (CK5); the first clock signal input terminal of the (6K+3)th stage gate driver circuit unit may be connected to the third clock line (CK3), and the second clock signal input terminal may be connected to the sixth clock line (CK6); the first clock signal input terminal of the (6K+4)th stage gate driver circuit unit may be connected to the fourth clock line (CK4), and the second clock signal input terminal may be connected to the first clock line (CK1); the first clock signal input terminal of the (6K+5)th stage gate driver circuit unit may be connected to the fifth clock line (CK5), and the second clock signal input terminal may be connected to the second clock line (CK2); the first clock signal input terminal of the (6K+6)th stage gate driver circuit unit may be connected to the sixth clock line (CK6), and the second clock signal input terminal may be connected to the third clock line (CK3); wherein K is an integer greater than or equal to 0.

Figure 14:
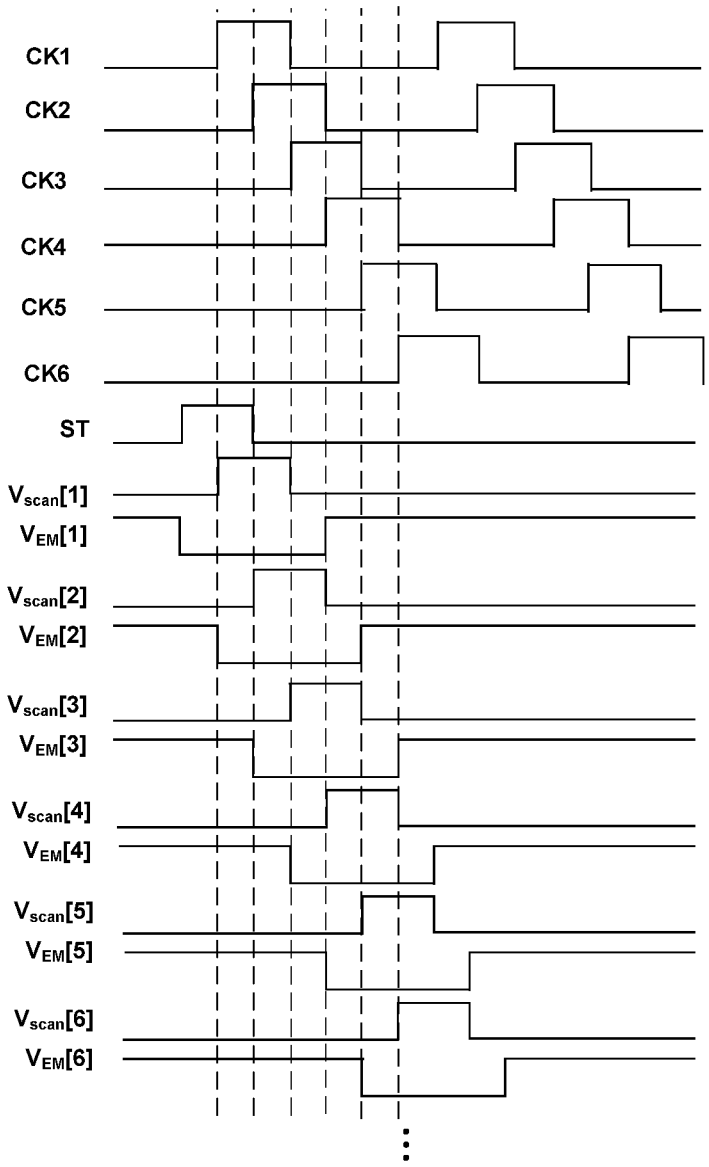
FIG. 14 illustrates another sequence diagram of the gate driver circuit according to Embodiment V of the present application.

FIG. 14 illustrates a sequence diagram of the gate driver circuit according to the preferred embodiment, wherein the first clock line (CK1), the second clock line (CK2), the third clock line (CK3), the fourth clock line (CK4) the fifth clock line (CK5), and the sixth clock line (CK6) provide six overlapping phase clock signals, and clock signals provided by adjacent clock lines overlap by a pulse width of ½ high voltage level. The scanning signals and the light emitting signals output by the gate driver circuit of FIG. 14 can meet the sequence requirement of a pixel driver circuit of FIG. 2(*d*), wherein the sequence of each gate driver circuit unit in the gate driver circuit is shown in FIG. 4(*f*).

Embodiment VI

Figure 15:
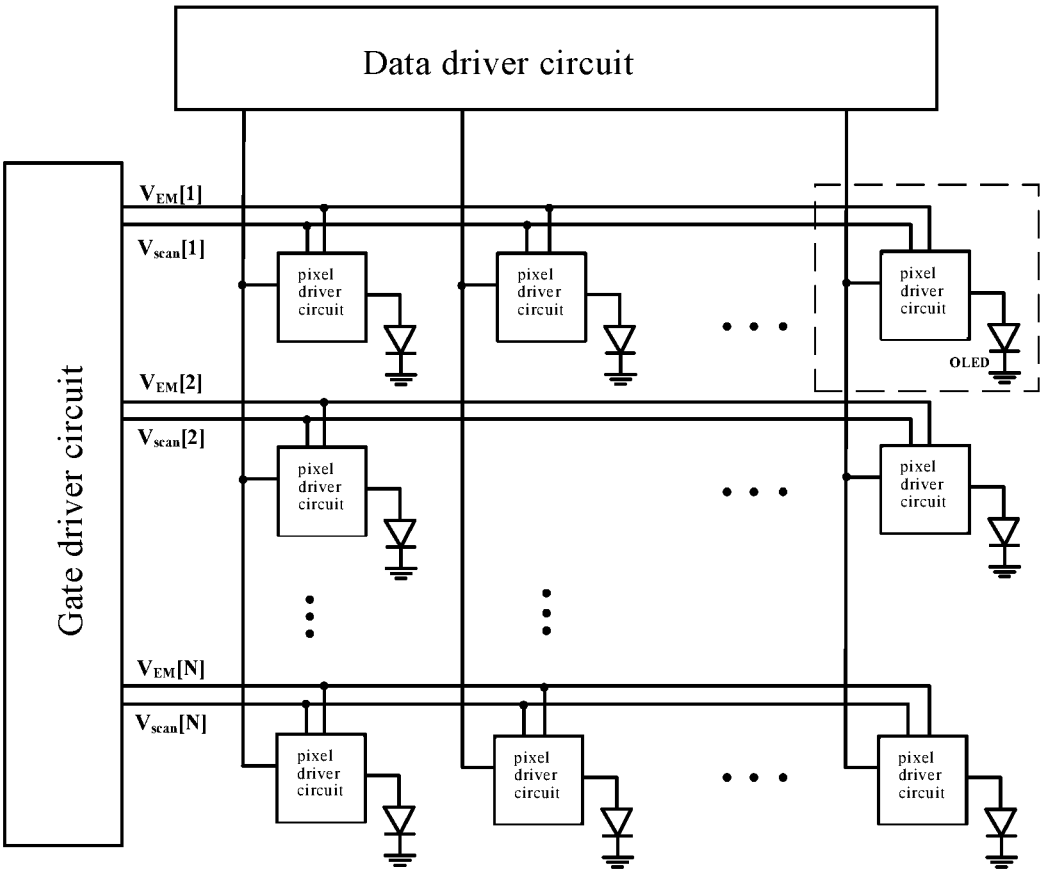
FIG. 15 illustrates a structure diagram of the organic light emitting diode panel according to Embodiment VI of the present application.

FIG. 15 illustrates an organic light emitting diode panel according to the present application. The organic light emitting diode panel may comprise a two-dimensional pixel array including a plurality of pixels. The pixel may have the structure of the pixel driver circuit illustrated in FIG. 1. The organic light emitting diode panel may also comprise a data driver circuit for providing a data signal comprising a video image signal to the pixels. The data driver circuit may be connected to each pixel through a data line. The organic light emitting diode panel may also comprise the gate driver circuit of Embodiment IV or Embodiment V for providing a scanning signal Vscan and a light emitting signal VEM to each pixel. The gate driver circuit may be connected to each pixel through a scanning line and a light emitting control terminals. The gate driver circuit of the present application can be integrated, in the form of thin film transistor, on the array substrate of an organic light emitting diode panel, so as to achieve the objectives of reducing cost, improving reliability, and realizing narrow bezel etc.

In view of the above, the gate driver circuit of the present application can generate the scanning signal and the light emitting signal simultaneously, which are needed in the pixel driver circuit of an organic light emitting diode panel. Furthermore, pulse width of scanning signals can be adjusted by changing the number of and ways of connection of the clock signals of the gate driver circuit. The gate driver circuit and the unit thereof proposed in this application have the advantages of simple structure, good driving capability and wide application range etc.

Specific embodiments are used to illustrate the present application. These embodiments are merely used to help to understand the present application and are not to be constructed as limiting the present application. Those skilled in the art can make various variations to the above specific embodiments according to the concept of the application.

What is claimed is:

1. A gate driver circuit unit, comprising: a scanning signal generating unit for generating a scanning signal, configured to transmit a first clock signal to a scanning signal output terminal under the control of a pulse signal and to pull down and maintain the voltage of the scanning signal output terminal at low voltage level under the control of a second clock signal; a light emitting signal generating unit for generating a light emitting signal, configured to pull down the voltage of a light emitting signal output terminal under the control of the pulse signal, and to couple the light emitting signal output terminal to a high voltage supply under the control of the second clock signal;

wherein the scanning signal generating unit comprises: a first pull-up module comprising a first control terminal, the first control terminal of the first pull-up module being configured to transmit the first clock signal to the scanning signal output terminal after obtaining the driving voltage; an input module configured to receive the input pulse signal from the pulse signal input terminal to provide the driving voltage to the first control terminal of the first pull-up module; and a first pull-down module down and maintain the voltage of the scanning signal output terminal at low voltage level under the control of the second clock signal.

2. The gate driver circuit unit of claim 1, wherein:

the light emitting signal generating unit comprises a second control terminal, a second pull-up module, and a second pull-down module;

the second control terminal being configured to, after obtaining a driving voltage, drive the second pull-up module to pull up and maintain the voltage of the light emitting signal output terminal;

the second pull-up module being configured to charge the second control terminal to provide the driving voltage when the second clock signal is at high voltage level; and the second pull-down module is configured to, when the pulse signal is at high voltage level, pull down the voltages of the light emitting signal output terminal and the second control terminal.

3. The gate driver circuit unit of claim 2, wherein:

the second pull-up module comprises a first transistor and a second transistor;

a control electrode of the second transistor being configured to input the second clock signal, a first electrode of the second transistor being connected to the high voltage supply, a second electrode of the second transistor being connected to the second control terminal to charge the second control terminal when the second clock signal is at high voltage level, so as to provide the driving voltage; and a control electrode of the first transistor being connected to the second control terminal, a first electrode of the first transistor being connected to the high voltage supply, a second electrode of the first transistor being connected to the light emitting signal output terminal to charge the light emitting signal output terminal by the high voltage supply after the first transistor is turned on by the driving voltage.

4. The gate driver circuit unit of claim 3, further comprising a capacitor connected between the control electrode and the second electrode of the first transistor.

5. The gate driver circuit unit of claim 2, wherein:

the second pull-down module comprises a first transistor and a second transistor;

a control electrode of the first transistor being connected to the pulse signal input terminal to input a pulse signal, a second electrode of the first transistor being connected to a low voltage supply, and a first electrode of the first transistor being connected to the light emitting signal output terminal to pull down the voltage of the light emitting signal output terminal through the low voltage supply when the input pulse signal is at high voltage level;

a control electrode of the second transistor being connected to the pulse signal input terminal to input the pulse signal, a second electrode of the second transistor being connected to the low voltage supply, and a first electrode of the second transistor being connected to the second control terminal to pull down the voltage of the second control terminal through the low voltage supply when the input pulse signal is at high voltage level.

6. The gate driver circuit unit of claim 1, wherein: the input module comprises a first transistor, both a first electrode and a control electrode of the first transistor are being connected to the pulse signal input terminal to input the pulse signal, and a second electrode of the first transistor being connected to the first control terminal of the first pull-up module to charge the first control terminal of the first pull-up module when the input pulse signal is at high voltage level, so as to provide the driving voltage; the first pull-up module comprises a second transistor and a capacitor the capacitor being connected between a control electrode and a second electrode of the second transistor, a control electrode of the second transistor being the first control terminal, the first electrode of the second transistor being configured to input the first clock signal, and the second electrode being connected to the scanning signal output terminal and configured to, after the second transistor is turned on by the driving voltage, charge the scanning signal output terminal when the first clock signal is at high voltage level and to discharge the scanning signal output terminal when the first clock signal is at low voltage level; the first pull-down module comprises a third transistor and a fourth transistor;

a control electrode of the third transistor is configured to input the second clock signal, a second electrode being connected to the low voltage supply, and a first electrode being connected to the scanning signal output terminal to discharge the scanning signal output terminal through the low voltage supply when the second clock signal is at high voltage level; a control electrode of the fourth transistor is configured to input the second clock signal a second electrode being connected to the low voltage supply, and a first electrode being connected to the first control terminal to discharge the first control terminal through the low voltage supply when the second clock signal is at high voltage level.

7. The gate driver circuit unit of claim 1, further comprising a low voltage level maintenance unit configured to down and maintain the voltages of the first control terminal and the scanning signal output terminal at low voltage level under the control of the light emitting signal.

8. The gate driver circuit unit of claim 7, wherein:

the low voltage level maintenance unit comprises a fifth transistor and a sixth transistor;

a control electrode of the fifth transistor is connected to the light emitting signal output terminal for inputting the light emitting signal, a second electrode of the fifth transistor being connected to the low voltage supply and a first electrode being connected to the scanning signal output terminal to discharge the scanning signal output terminal through the low voltage supply when the light emitting signal is at high voltage level so as to maintain the voltage of the scanning signal output terminal at low voltage level; and a control electrode of the sixth transistor is connected to the light emitting signal output terminal for inputting the light emitting signal, a second electrode of the sixth transistor being connected to the low voltage supply and a first electrode being connected to the first control terminal to discharge the first control terminal through the low voltage supply when the light emitting signal is at high voltage level so as to maintain the voltage of the first control terminal at low voltage level.

9. The gate driver circuit unit of claim 1, wherein the light emitting signal generating unit further comprises:

an initialization signal input terminal for inputting an initialization signal; and an initialization module configured to, when the initialization signal (VRST) is at high voltage level, pull up the voltage of the light emitting signal output terminal to high voltage level and pull down the voltage of the scanning signal output terminal to low voltage level.

10. The gate driver circuit unit of claim 9, wherein the initialization module comprises:

a transistor, wherein a first electrode and a control electrode of the transistor is coupled to the initialization signal input terminal, and a second electrode of the transistor is coupled to the second control terminal.

11. A display, comprising:

a pixel array;

a data driver circuit coupled to the pixel array; and a gate driver circuit coupled to the pixel array;

wherein the gate driver circuit comprises a plurality of cascaded gate driver circuit units in accordance with claim 1;

wherein for the pulse signal input terminal of the Nth unit is coupled to the scanning signal output terminal of the N-1th unit, wherein N is an integer greater than 1, and the pulse signal input terminal of the first unit is configured to receive a predetermined signal.

12. The display of claim 11, wherein the initialization signal input terminal for each unit is in accordance with claim 9 and is configured to receive an initiation signal, and a rising edge of the initiation signal precedes that of the pulse signal.

13. A method of generating scanning signals and light emitting signals for display, the method executed by one of a plurality of gate driver circuit units of a gate driver circuit of the display, wherein one of a plurality of gate driver circuit units comprises a scanning signal generating unit and a light emitting signal generating unit and wherein the method comprises, transmitting a first clock signal, by the scanning signal generating unit, to a scanning signal output terminal at least under control of a pulse signal;

transmitting a first reference signal to a light emitting signal output terminal as a light emitting signal at least under control of a second clock signal;

pulling down the voltage at the scanning signal output terminal to a second reference signal, by the scanning signal generating unit, at least under control of the second clock signal, and maintaining the pulled down voltage, by the scanning signal generating unit, at least under control of the light emitting signal; and pulling down the voltage at the light emitting signal output terminal to the second reference signal, by the light emitting signal generating unit, at least under control of the puke signal;

wherein:

the first clock signal and the second clock signal are of the same period and duty cycle but with different phases;

a rising edge of a high voltage level of the first clock signal precedes that of the second clock signal;

a rising edge of a high voltage level of the pulse signal precedes that of the first clock signal; and a falling edge of the high voltage level of the pulse signal precedes that of the second clock signal.

* * * * *